United States Patent [19]

Gentry et al.

[11] 4,436,048

[45] Mar. 13, 1984

[54] ROTARY TRANSFER SUBSYSTEMS AND TENSIONING ASSEMBLIES FOR A PROCESS VESSEL

[75] Inventors: Larry L. Gentry, Sunnyvale; Herbert H. Moss, Cupertino, both of Calif.; Narayana N. Panicker, Grand Prairie, Tex.; William T. Wada, Sunnyvale, Calif.

[73] Assignee: Mobil Oil Corporation, New York, N.Y.

[21] Appl. No.: 391,070

[22] Filed: Jun. 22, 1982

[51] Int. Cl.[3] ..... E21B 43/01

[52] U.S. Cl. ..... 114/230; 141/382; 166/355

[58] Field of Search ..... 114/74 R, 74 A, 74 T; 141/1, 9, 283, 285, 382, 387; 166/350, 352, 353, 354, 355; 137/154, 236 S, 355.12, 355.16, 355.17, 355.2, 355.26, 580, 594, 899.1, 899.2; 254/277; 285/61, 119, 122, 132, 134; 441/4, 5; 405/202

[56] References Cited

U.S. PATENT DOCUMENTS

| | | | |
|---|---|---|---|
| 3,602,302 | 8/1971 | Kluth | 166/352 X |
| 3,742,536 | 7/1973 | Sada et al. | 441/5 |
| 4,052,090 | 10/1977 | Stafford | 285/61 |
| 4,388,022 | 6/1983 | Gentry et al. | 166/350 X |

*Primary Examiner*—Stephen Marcus
*Assistant Examiner*—Mark Thronson
*Attorney, Agent, or Firm*—A. J. McKillop; M. G. Gilman; G. W. Hager, Jr.

[57] ABSTRACT

A rotary transfer subsystem is described for transferring production fluids, electrical power, hydraulic power, and control signals across a rotating interface between an offshore process vessel and a flowline bundle of service hoses and high-pressure hoses which are connected to a deepwater production riser system. Tensioning devices are also described for maintaining a selected tension on terminal hoses between the interface and the vessel while the vessel weathervanes during maintenance of position in a watch circle above the riser system. The subsystem and the tensioning devices are mounted on the vessel which is equipped with a powered turret within a circular moonpool and is capable of performing most subsea service functions on the riser system without major equipment support. The subsystem and the tensioning devices, in combination, comprise a column assembly which is attached to the turret and supports horizontal loops of terminal hoses; a multipassage swivel for accommodating a portion of the terminal hoses not containing gas; a tower for selectively tensioning these hoses and for connecting them to production piping; a traveling sheave and drive mechanism which supports horizontal loops of the remaining hoses while maintaining tension on them and adjusting their lengths, between connections to storage facilities in the vessel and to the column assembly, while the column assembly remains rotatably stationary with respect to the flowline bundle during weathervaning of the vessel through at least 270°; and hose support trays for supporting horizontal spans of all hoses between the tower and the column and between the column and the traveling sheave.

20 Claims, 37 Drawing Figures

FIG. 6
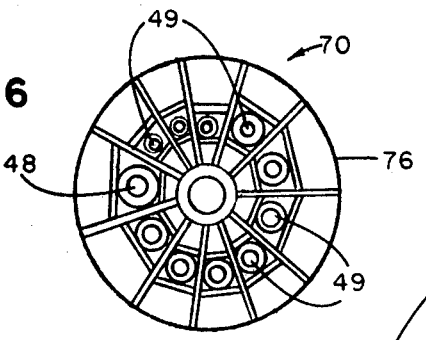
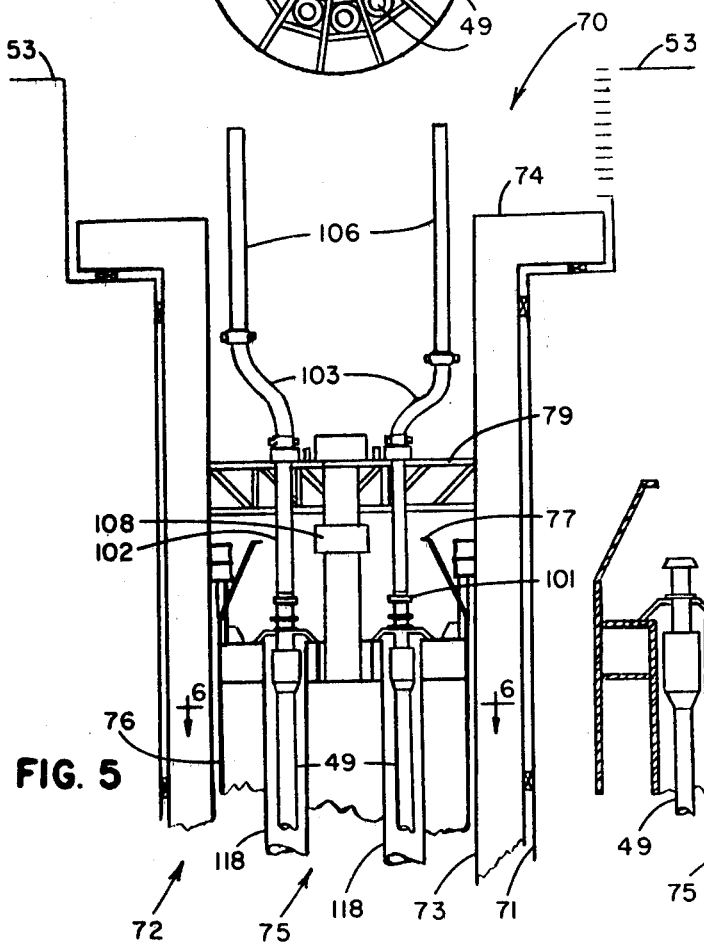
FIG. 5
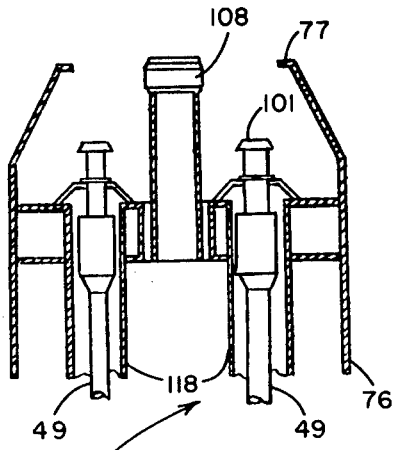
FIG. 7

85
129
53
110
122
133
114
12
131
120
130
135
139
137
105
12
109
115
113
111
106
105
72
74
73
117
152
155
140
144
145
141
158
151
109
146
159
53

129
127
139
139
120
105

ROTARY TRANSFER SUBSYSTEMS AND TENSIONING ASSEMBLIES FOR A PROCESS VESSEL

1. BACKGROUND OF THE INVENTION

This invention relates to marine process vessels adapted for subsea work. In particular, it relates to a novel subsystem and tensioning devices on such a vessel for transferring fluids from an underwater flowline bundle to on-board storage facilities while the vessel weathervanes about the bundle.

After a subsea well has been completed and a wellhead or group of wellheads are to be connected in fluid flow to the water surface through a production riser, a surface facility is required to receive the hydrocarbon fluids for processing or transfer to other transport vessels. When this operation is carried out in open sea or otherwise subject to significant variations in tides, currents and weather conditions, a compliant riser system may be employed to establish fluid communication between the surface vessel and subsea locations. Installation of such a compliant riser system can require handling of flexible conduits, which serve as oil and gas flowlines, as hydraulic control lines, and as service lines between the surface facility and the wellheads. Such flowlines contain petroleum and/or gas at high pressure and are subject to abrasion and entangling from currents and waves.

In a typical compliant riser system, a relatively fixed lower riser section extends from the marine floor to a submerged location below a zone of turbulence, at which point it may terminate with a buoy section. Between the buoyed lower riser section and the surface facility, a flexible flowline bundle can be utilized to accommodate the vertical fluctuations, currents, etc., which may result in large lateral excursions of the surface facility relative to the lower riser section as well as heaving action due to waves and tides.

The lower riser section may be installed by a floating drilling vessel or semi-submersible rig in a known manner, but major installations, repairs, and replacement operations, such as installation of the flexible flowline bundle portion and maintenance thereof by replacement of individual conduits, require bringing additional specialized vessels to the scene. There is consequently increased risk of multiple collision between large vessels, increased cost, and a likelihood that personnel who are unfamiliar with the compliant riser system will be involved in the operation.

This situation has therefore created a need for a surface vessel that is capable of continued functioning as a workship as well as a processing and/or fluid handling unit. Such self-contained service capability provides faster on-site response, least cost, least risk of vessel collisions during operations, and best-trained personnel always on station.

Offshore loading of ocean-going tankers and of process vessels at underwater production sites has generally required the ship to be moored and multiply connected by transfer lines to a turret around which the ship weathervanes while receiving hydrocarbon fluids from the riser. A multiport swivel joint is fixed securely to the turret and has an inlet portion which does not change in orientation to a substantial extent and an outlet portion which revolves as the vessel weathervanes so that it is always oriented toward the vessel. Examples of such structures are described in the following U.S. patents which are incorporated herein by reference: U.S. Pat. Nos. 2,894,268; 3,077,615; 3,082,440; 3,187,355; 3,236,266; 3,237,220; 3,258,793; 3,430,670; 3,614,869; 4,052,090; 4,067,080; 4,107,803; 4,138,751; 4,155,670; 4,173,804; and 4,183,559.

There has been some development, however, of dynamically positioned process vessels having a multiport swivel joint as an integral part of the vessel. Typically, the swivel joint is attached to a support structure, projecting like a bowsprit from the bow or the stern, or is connected to a moonpool within the vessel. Fluid transfer lines connect the outlet portion of the swivel joint to storage facilities on the vessel. These transfer lines must be kept under substantially uniform tension and above all must not become entangled because of changes in length as the vessel weathervanes. Examples of such vessels are given in U.S. Pat. Nos. 3,335,690; 3,407,768; 3,590,407; and 3,602,302. In addition, the fluid swivels described in U.S. Pat. No. 4,126,336 and 4,183,559 appear to be adaptable to installation aboard a process vessel. All of these patents are incorporated herein by reference.

However, the known swivel joints, whether or not a part of the process vessel, are subject to pressures as high as 10,000 psi and contain a variety of petroleum and hydraulic fluids having a wide range of pressures, viscosities, and corrosiveness. They are, consequently, likely to develop leaks to the environment or from one fluid to another. Natural gas, because of its typically high pressures and high fluidities, often makes severe demands on the seal systems of swivel joints and is better adapted to other types of rotating interfaces between inlet hoses and transfer hoses. Moreover, a multiport swivel joint which is handling fluids is generally not adapted for handling electrical control and power lines which are as susceptible to entanglement as the fluid transfer lines because of the weathervaning of the vessel about the inlet portion of the swivel joint.

It is accordingly an object of this invention to provide rotary transfer systems for fluids and electrical lines across interfaces between the vessel and the flexible flowline bundle.

It is another object to provide tensioning means for maintaining the transfer hoses of the rotary transfer systems under a selected tension as the vessel weathervanes.

2. SUMMARY OF THE INVENTION

In accordance with these objectives, a fluid transfer subsystem and tensioning mechanism are provided in a process vessel for transferring fluids and electrical lines across a rotating interface between the flowline bundle and connecting lines to on-board storage facilities. The vessel itself is not a part of this invention but is described hereinafter to provide a clear understanding of the environment for the invention. The vessel is the invention of a related application, Ser. No. 06/391,078, entitled "Marine Surface Facility Work Station for Subsea Equipment Handling".

The vessel generally comprises a pair of moonpools and numerous pieces of auxiliary equipment, including winches, hose reels, and a derrick, which are disposed on the main deck around the moonpools and are used for: (a) storing and selectively lowering hoses of various types and sizes into the water and manipulating the hoses and associated component parts to form the flowline bundle; (b) suspending the bundle while connecting its intake end to the buoyed riser section and its outlet end to a rotary fluid transfer subsystem of this invention on the vessel; and (c) retrieving individual hoses and even the entire bundle when maintenance or replacement thereof is needed. The moonpools and associated equipment and the interactive usages of the moonpools and these pieces of equipment are not components of this invention.

Additional major items of equipment, that are disposed on or near the main deck, are components of this invention and include:

(1) rotary transfer subsystems, including a plurality of transfer hoses, for transferring fluids and electrical lines across rotating interfaces between the vessel and the bundle, and (2) tensioning means, for maintaining tension on the transfer hoses which are disposed between the interfaces and storage facilities on vessel while the vessel receives production fluids and weathervanes under power around its turret plug within one of the moonpools.

The vessel specifically comprises: (1) a service moonpool and a circular turret moonpool, both extending vertically from its main deck to open bottom ends below the waterline of the vessel; (2) below-deck storage facilities communicating with at least one of the moonpools; and (3) cooperatively interacting feed and retrieval means at each moonpool for: (a) introducing a plurality of service hoses and high-pressure hoses into the water beneath the vessel, (b) keelhauling and slinging the hoses between the moonpools, (c) selectively working simultaneously on both ends of the hoses, (d) equipping the hoses with selected component parts to form a flowline bundle as a sling or catenary between the moonpools and beneath the vessel, and (e) selectively lowering the intake end of the flowline bundle from the service moonpool to the lower riser system which extends from the sea floor while the discharge end of the flowline bundle remains secured to a removable plug within the turret moonpool.

The moonpools are in longitudinal alignment in the forward portion of the vessel, one being circular and the other being four-sided. The four-sided moonpool is a service moonpool having a rectilinear horizontal cross section extending vertically through the hull from the main deck to the open bottom end. This service moonpool is at least about 30 feet by 40 feet in plan view and is disposed forward of the turret moonpool.

The storage facilities are disposed between the main deck and the water level adjacent to the service moonpool and comprise an off-set shelf extending into the hull from the service moonpool for storage of the component parts and installation tools for the flowline bundle, with a pair of monorail cranes disposed overhead. The service moonpool is provided with a rig floor which is equipped with slips to support tubulars ranging from 4½ inch I.F. drill pipe to 12-inch 6,000 psi riser tubing. Preferably, the rig floor can support a weight of at least about 150 tons and is a rotary table.

The process vessel also has a derrick which is attached to the main deck, is disposed over the service moonpool, and has draw works sized to handle about 150 tons. The draw works comprise a derrick sheave which is supported by the derrick, is able to swivel in azimuth, is capable of handling the hoses in all sizes used for servicing the riser system, and is at least about 20 feet in diameter.

The feed and retrieval means comprise a plurality of powered hose storage reels and a plurality of winches which are disposed adjacent to the moonpools. The storage reels are positioned to be radially aligned with the derrick sheave.

The winches are of four types. Specifically, the winches comprise lift winches, guide wire winches, flowline support wire winches, and a plug lay down winch.

There are two lift winches. They are located forward of the service moonpool and have tensioners to prevent impact of the yoke and riser buoy during installation of the flowline bundle on the riser system. These winches handle the yoke and flowline bundle during initial installation. They are also used for recovery of the flowline bundle after an emergency disconnect operation. A sheave for each lift line is mounted in the derrick.

The guide wire winches are disposed at each corner of the service moonpool and are aligned with sheaves in the derrick to allow different guideline spacing for gooseneck installation, yoke installation, and hose replacement operations.

The flowline support wire winches are doubledrum waterfall winches handling two wires and comprise a first support wire winch which is disposed aft of the service moonpool and has snatch blocks on the main deck to fair lead support wires to either side of the service moonpool for handling and replacing support wires for the flowline bundle. The flowline support wire winches further comprise a second support wire winch which is disposed aft of the turret moonpool for handling support wire pull-in and replacement operations at the turret moonpool. These support wire winches utilize the lift line sheaves in the derrick because support wires and lift wires are not required at the same time.

The plug lay down winch is disposed adjacent to the turret moonpool and provides handling capacity for plug ejection and pull-in operations (when an operational disconnection is being performed) and for keelhauling hoses between moonpools for installation and replacement operations, while cooperatively interacting with the hose storage reels, guide wire winches, and lift winches. The lay down winch handles a laydown line which passes over a sheave centered over the turret moonpool.

A pedestal crane is attached to the main deck adjacent to each moonpool. Both cranes are preferably a 25-ton swivel, and are used for handling equipment at these moonpools.

The components for the flowline bundle, which are stowed in the storage facilities adjacent to the service moonpool, comprise gooseneck piping spools for connecting the flowline bundle to the riser system, a gooseneck running tool, a plurality of spreader beams for immobilizing the hoses within the flowline bundle, and a flowline yoke for immobilizing the hoses of the flowline bundle at their intake ends while these ends are within the service moonpool, and for connecting this intake end to the riser system.

A remote control vehicle is carried on the vessel and is selectively launched through the service moonpool for carrying out the keelhauling and slinging operations.

The turret moonpool comprises a circular turret into which a plug is selectively pulled, whereby the turret is effectively closed so that dynamic loads on the plug are reduced in heavy seas because rise and fall of water in the turret is minimized. Preferably, the turret moonpool and the plug are cylindrical in shape but may be conical, for example. This plug comprises a plurality of circularly arranged openings through which the discharge ends of all of the flexible pipes in the flowline bundle are pulled from the service moonpool, whereby the discharge ends are all above water level to allow manual inspection and replacement of connection components. A structural support frame is attached to the walls of the cylindrical turret, and the plug is rotatably and detachably connected to the sides of the turret below this support frame. A rotating device, attached to the the turret, selectively rotates the plug for any minor alignment of flexible pipe bundles necessary for the connection.

A plurality of elongated connectors are supported by this frame and are selectively connected at their lower ends to the discharge ends of the individual hoses, whereby the heavy hoses are supported independently of the plug with a constant upward force which minimizes upward and downward mechanical motions that might cause fatigue loads. These connectors are locked and unlocked by remote control, and the upper ends of the connectors are connected to vertically disposed production piping, one pipe for each of the hoses, which is disposed within the turret.

The process vessel further contains the rotary fluid transfer subsystems of this invention for transferring prodution fluids, electrical power, hydraulic power, and control signals across rotating interface between the offshore process vessel and the flowline bundle and the tensioning means of this invention for maintaining a selected tension on terminal hoses between the interface and storage facilities on the vessel. The subsystem and tensioning means enable the vessel to continue to receive production fluids from the riser section while weathervaning under power around its plug and while functioning on a 24-hour basis as a maintenance depot for the underwater flowlines.

This subsystem comprises, in combination with the tensioning means, a column assembly which is attached to the turret and supports horizontal loops of terminal hoses, a multipassage swivel for accommodating the large liquid-containing terminal flexible hoses (not containing gas), a tower for selectively tensioning these hoses and for connecting the hoses not containing gas to production piping, a traveling sheave and drive mechanism which supports horizontal loops of the remaining hoses (production pipes containing gas and service pipes) and which adjusts the lengths of the remaining pipes (between connections to storage facilities in the vessel and the column assembly) while the column assembly remains rotatably stationary with respect to the flowline bundle during weathervaning of the vessel through at least 270°, and hose support trays for supporting horizontal spans of the hoses between the tower and the column and between the column and the traveling sheave.

The turret within the turret moonpool is disposed between the tower and the traveling sheave and drive mechanism. The tower is used for individually tensioning the large liquid-containing terminal hoses which are connected to production piping at the tower.

The traveling sheave and drive mechanism comprises a sheave shaft, mounted on support beams, and a plurality of trolleys which ride on rails. These rails are aligned with the turret and are attached to the main deck of the process vessel. The sheave shaft is disposed in upright position and travels along the rails, being moved by a drive mechanism which comprises a friction gripper which is provided with a pulling cylinder and grips a rail disposed beneath the sheave shaft to provide the traveling movement over a distance of at least about 50 feet. The sheave shaft is provided with shelves which support the hoses as they wrap around the sheave shaft on a pitch radius of at least about eleven feet. The sheave shaft is either non-rotatable, whereby the hoses slide along the shelves, or is rotated as it travels. Means for minimizing friction between hoses and shelves are provided.

The column assembly comprises a circular column shaft which is equipped with shelves and is mounted atop the turret, production piping which is disposed on the inside of the column shaft and is attached to the connectors above the plug, and terminations for this piping which are disposed at different tangential positions throughout the height of the column shaft, a plurality of the remaining terminal hoses being attached to these terminations. The column shaft has the same diameter as the diameter of the sheave shaft. The top of the column shaft is at the same elevation above the main deck as the top of the sheave shaft, but the bottom of the column shaft is substantially below the main deck. Each remaining terminal hose wraps around the column shaft a minimum of two times at a minimum pitch diameter of about 20 feet, the first wrap being supported on one of the shelves, whereby storage capacity for these remaining hoses is provided on the column shaft. The remaining hoses are horizontally extended to the sheave shaft which controls their tension by its traveling and rotating.

A multi-passage swivel is mounted atop the column shaft for the liquid-containing high-pressure hoses, a preferred multi-passage swivel being a three-passage torroidal swivel comprising three torroidal chambers and seals beteen the outer and inner rows of each chamber, the inner row moving with the turret and the outer row moving with the process vessel. Hoses pass from the swivel to the tower and include all high-pressure hoses.

Hose support trays are attached to a plurality of support columns and support the horizontal reaches of all terminal hoses. Columns supporting the remaining terminal hoses are disposed in a pair of rows in parallel to and straddling the rails. These support columns are each provided with a plurality of horizontally disposed arms which may be fixed but are preferably swingable from a position that is perpendicular to the rails to a position that is parallel thereto as the sheave column travels past the support columns. In addition, a support frame and sheaves are mounted atop the column shaft for handling laydown lines attached to the turret plug when it is selectively pulled into the turret.

The method for operating an offshore process vessel, having an elongated hull, a main deck, a powered turret moonpool, a service moonpool, below-deck storage facilities communicating with the service moonpool, hose storage reels which are operable through the service moonpool, wire winches which are operable through both moonpools, and hose tensioning means which are operable through the turret moonpool, includes a method for assembling a plurality of service and production hoses into a flowline bundle to be connected to a fixed production riser section extending from the marine floor to a subsurface buoy at a submerged location below a zone of turbulence. This assembling method is not a part of this invention and comprises the following steps:

A. positioning the vessel over the subsurface buoy with the buoy substantially forward of the service moonpool;

B. positioning a removable plug in the turret moonpool;

C. lowering a keelhaul wire through the plug;

D. launching a remote control vessel through the service moonpool and conveying a light recovery line to the keelhaul cable with the remote control vehicle;

E. connecting the keelhaul wire and the light recovery line and returning the remote control vessel to the service moonpool while paying out the keelhaul recovery line;

F. pulling the keelhaul cable to the service moonpool and attaching to its end the largest diameter hose of the plurality of hoses;

G. repeating steps C through F until two bridle cables have been attached to two additional keelhaul cables;

H. paying out the largest hose and the two bridle cables into the water beneath the vessel for a portion of the lengths thereof;

I. moving a first spreader beam, having a plurality of lockable gates, from a stowed position in the storage facilities into the service moonpool, attaching the two bridle cables thereto, and installing the largest hose into the central gate of the spreader beams;

J. intermittently repeating step I a plurality of times until a plurality of spreader beams have been attached to the largest hose and to the bridle cables and until the entire length of the largest hose has been payed out and is hanging under the vessel;

K. pulling the three keelhaul cables attached to the largest hose and to the bridle cables to the turret moonpool;

L. lifting the largest hose and the bridle cables through guide tubes in the turret plug to a position at the top of the plug, securing the largest hose to the plug, and supporting the weight of the bridle cables and the spreader beams on the plug whereby the bridle cables and the hose form a sling beneath the vessel;

M. moving a yoke, having a plurality of lockable gates, from a storage position in the storage facilities to the service moonpool and locking the bridle cables and the largest hose thereunto;

N. repeating steps C, D, E, and F by lowering the keelhaul line, pulling in the keelhaul line with the remote control vessel, and connecting the keelhaul line to a plurality of additional hoses; and O. pulling the additional hoses from the service moonpool to the turret moonpool and through the plug and attaching the additional hoses to the gates in the yoke and to the gates in the plurality of spreader beams to form the flowline bundle between the moonpool as a sling beneath the vessel.

The yoke is hung onto lifting wires in step M in position for subsequent lowering of the intake end of the flowline bundle to the subsurface buoy. The keelhaul cables are kept at unequal lengths in step N to prevent fouling thereof until ready to begin step O. The plurality of spreader beams is preferably four and the plurality of hoses is preferably about eleven.

The connecting in step E is accomplished by snapping a snap hook, carried in the jaws of the manipulator of the remote control vehicle, into a snatch ring attached to the free end of each keel haul cable.

The largest hose is preferably secured to the plug with a split pedestal assembly and is hydraulically locked to a connector at its discharge end above the plug.

The largest hose is also pressure and leak tested from connector to connector over its whole length before the additional hoses are installed.

The discharge ends of the hoses are each fitted with a bull plug shaped pulling cap to assist in guiding the hoses into guide tubes in the plug.

THE DRAWINGS

Figure 8:
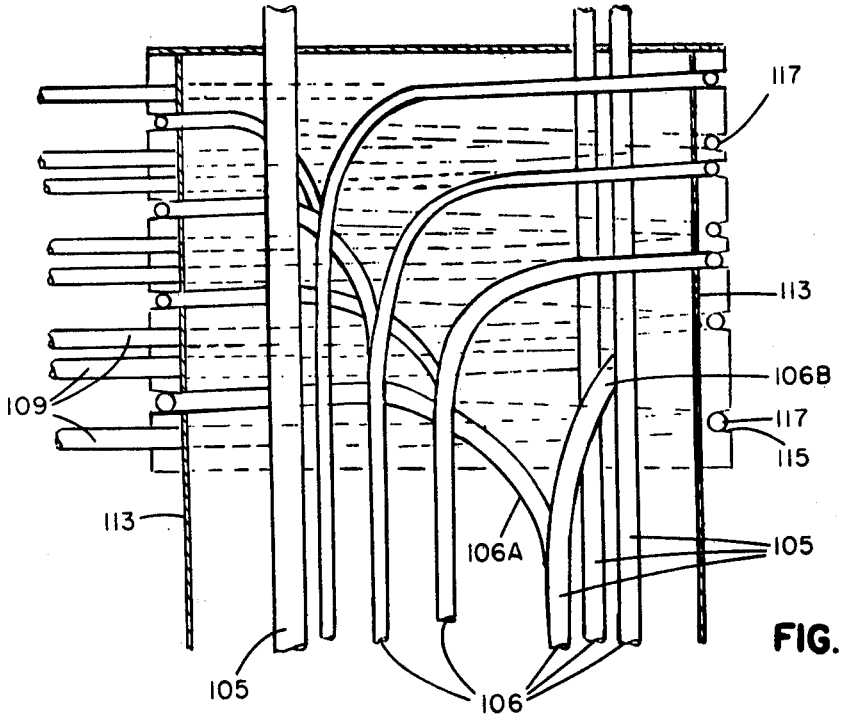
Figure 10:
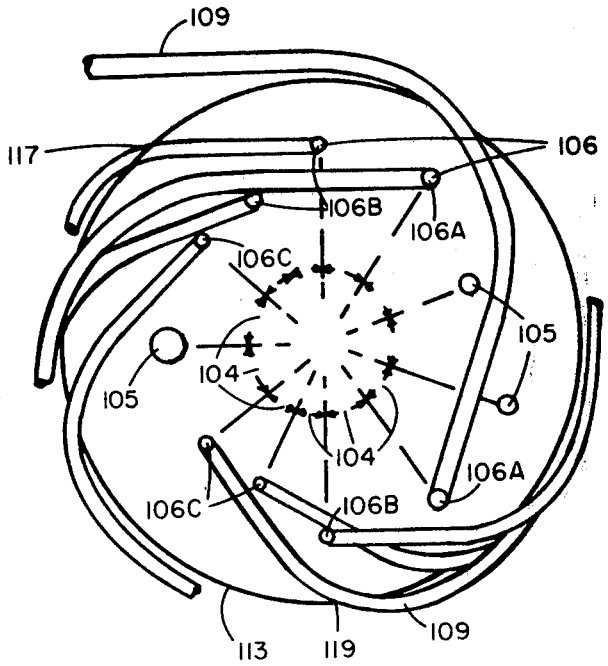
Figure 9:
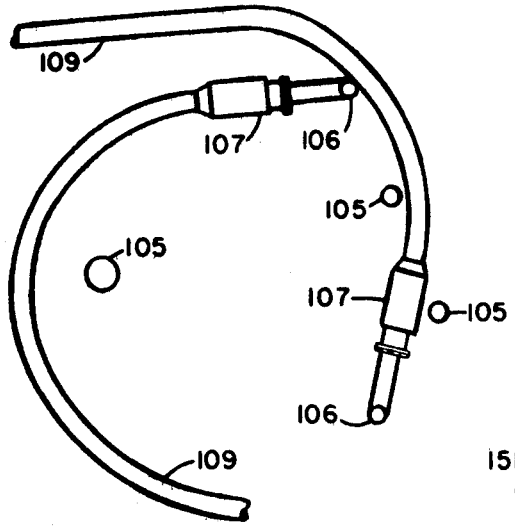
Figure 20:
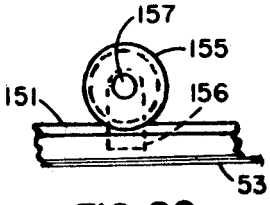
Figure 21:
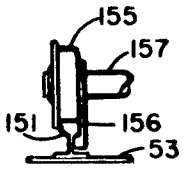
Figure 24:
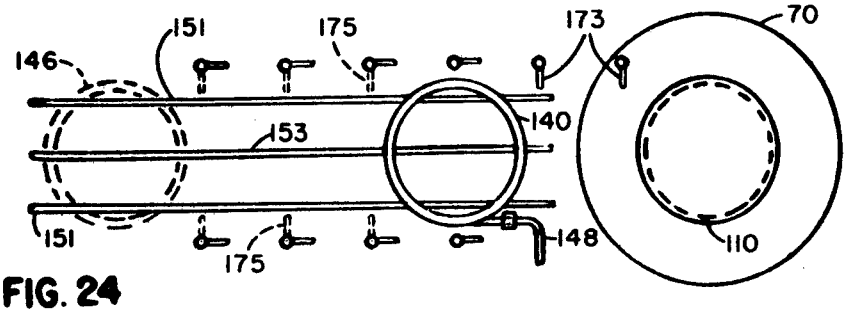
Figure 25:
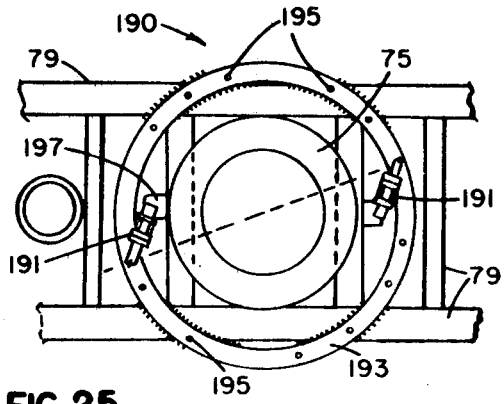
Figures 11, 12:
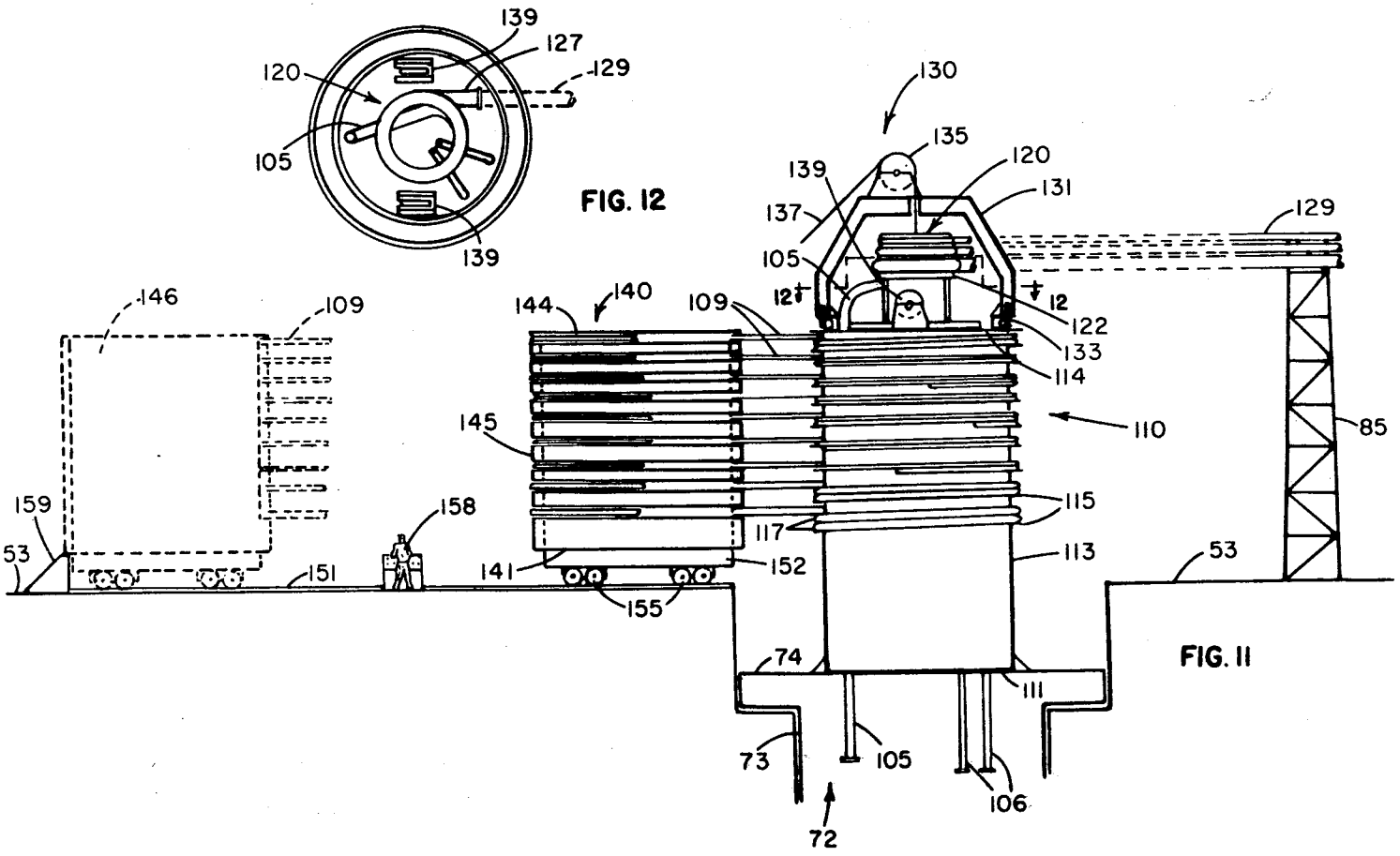
Figure 16:
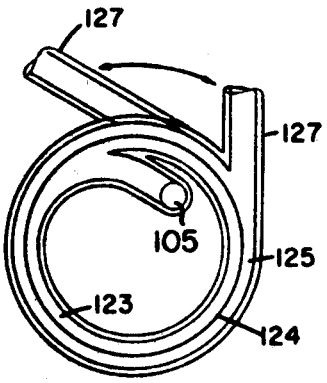
Figure 15:
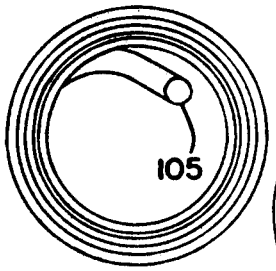
Figure 14:
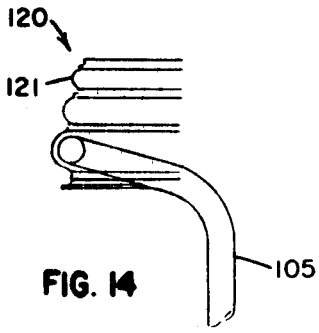
Figure 13:
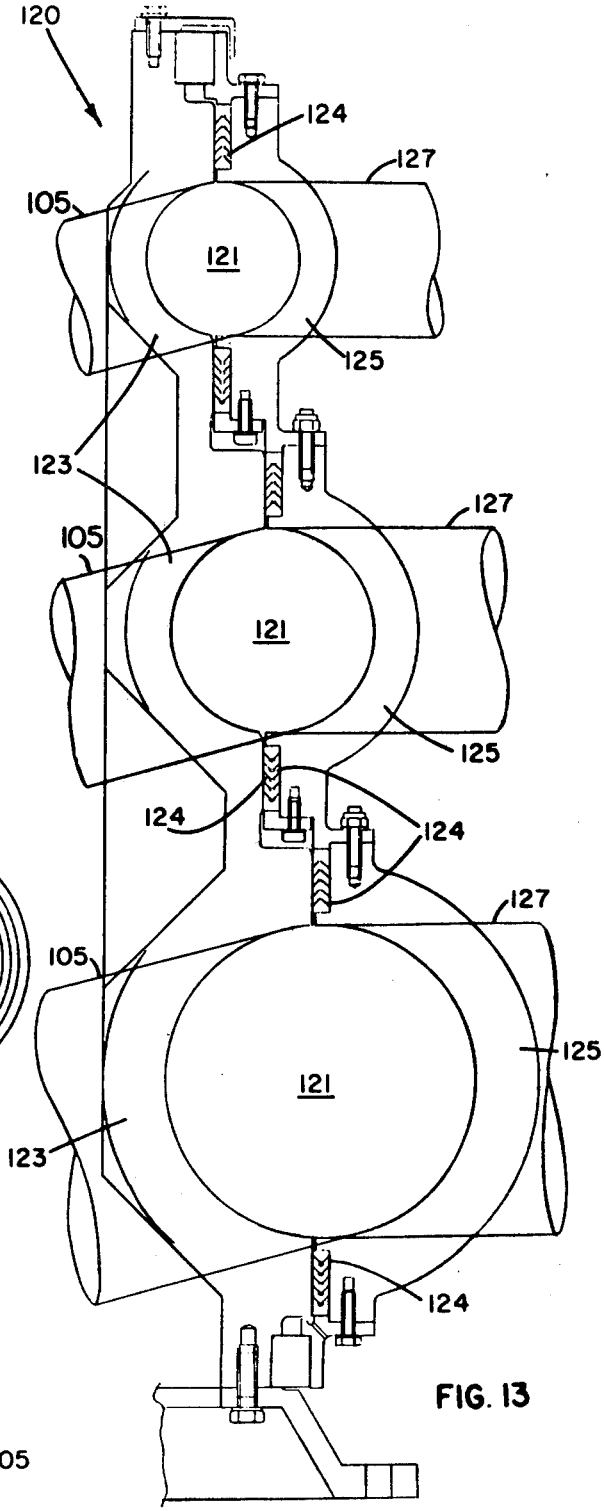
Figure 18:
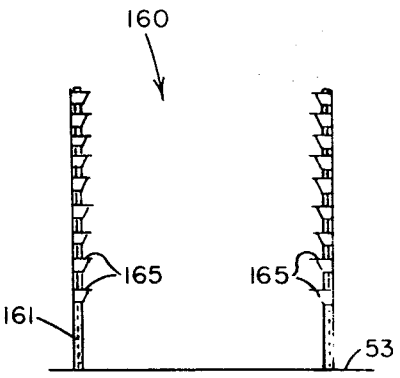
Figure 19:
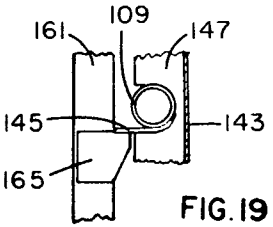
Figure 17:
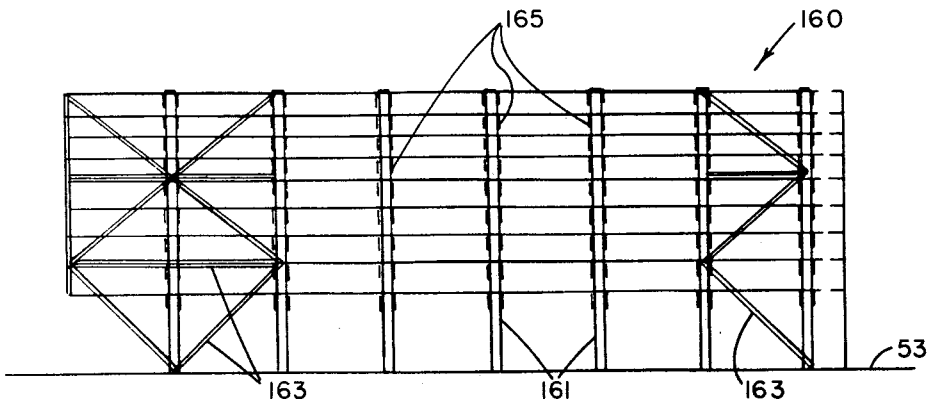
Figure 23:
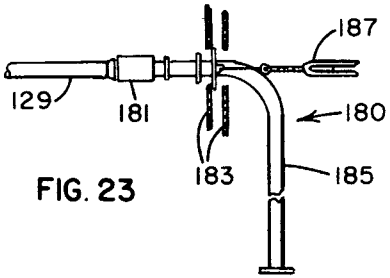
Figure 22:
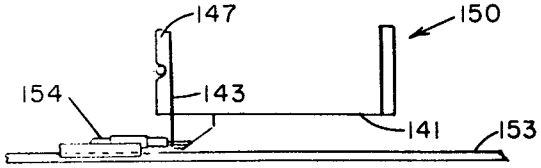

FIG, 5 is a cross-section elevation view of the turret plug, showing two hoses attached to connectors and then to rigid production piping;

FIG. 6 is a cross-section view along lines 6—6 of FIG. 5, showing all of the eleven service and production pipes passing through the plug;

FIG. 7 is a detailed side elevation view of the top of the plug, as seen in FIG. 5;

FIG. 8 is a cross-section elevation view of the production piping within the column shaft;

FIG. 9 is a plan view showing the arrangement of the piping and connectors for two pipes within the column shaft;

FIG. 10 is a plan view of the production piping within the column shaft;

FIG. 11 is a side elevational view of a rotary fluid transfer system in combination with two tensioning means for the terminal hoses, of this invention, comprising a column assembly which is attached to the top of the turret, a multi-passage swivel, a tower, and a traveling sheave and drive mechanism on the deck of the vessel;

FIG. 12 is a cross-section plan view of the multi-passage swivel;

FIG. 13 is a detailed side elevation sectional view of a three-passage torroidal swivel which is mounted atop the column shaft;

FIG. 14 is a partial side view of the swivel seen in FIG. 13;

FIG. 15 is a schematic plan view of one portion of the swivel of FIG. 13;

FIG. 16 is a schematic plan view of another portion of the swivel of FIG. 13;

FIG. 17 is a side elevational view of one embodiment of the hose support trays, having fixed arms, for the traveling sheave and drive mechanism;

FIG. 18 is a side view of the hose support trays shown in FIG. 17;

FIG. 19 is a detailed side elevational view in section of a fixed arm, as seen in FIG. 18, supporting a hose around the sheave shaft;

FIGS. 20 and 21 are schematic plan views of the traveling sheave and of another embodiment of the support trays, having rotating arms which are shown in two positions, the support position being in phantom;

FIG. 22 is a schematic side elevational view of a friction gripper and grip rail which are centered beneath the sheave shaft;

FIG. 23 is a side elevational view of a production pipe as it enters the tower and a turnbuckle device for individual tensioning of a terminal hose;

FIGS. 24 and 25 are a side elevational view and an end view, respectively, of a trolley wheel on a rail, the trolley wheel being provided with a flange to resist sideways sliding and overturning of the traveling sheave shaft;

FIGS. 26–37 illustrate the method of this invention for introducing, keelhauling, and slinging a plurality of service and high-pressure hoses into the water beneath the process vessel to form a flowline bundle.

Figure 26:
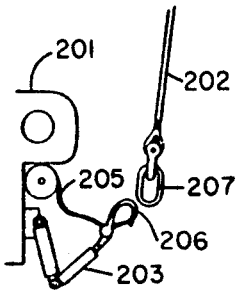
Figure 27:
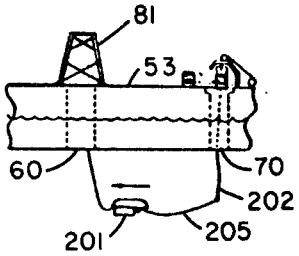
Figure 28:
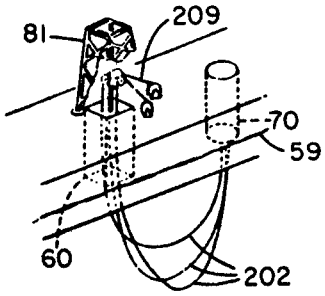
Figure 29:
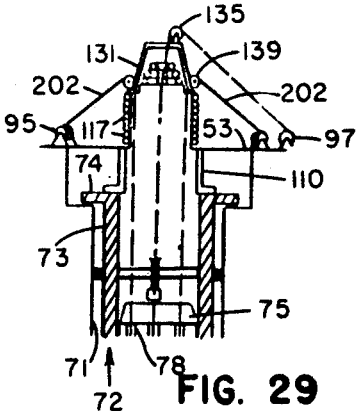
Figure 30:
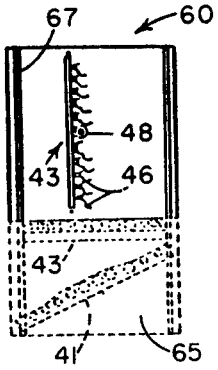
Figure 31:
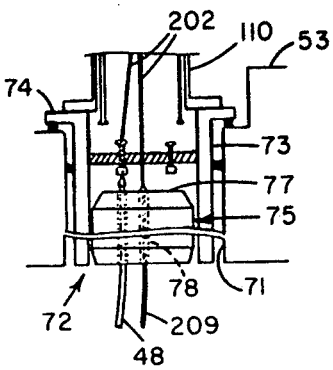
Figure 32:
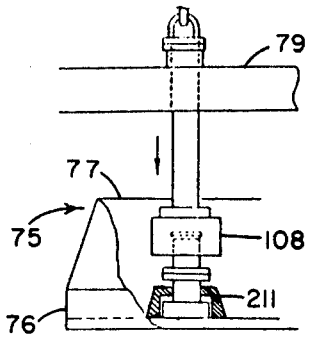
Figure 33:
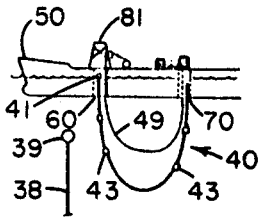
Figure 34:
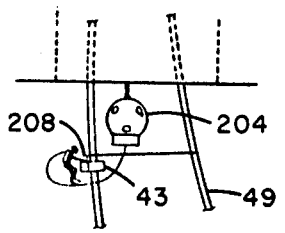
Figure 35:
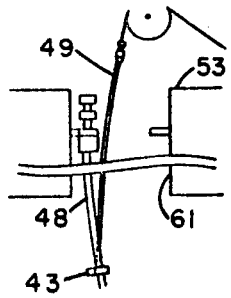
Figure 36:
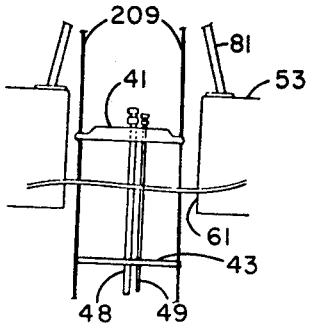
Figure 37:
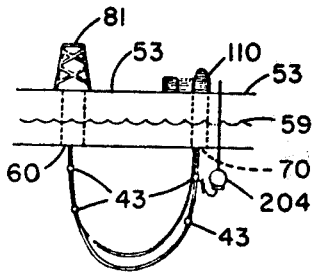

FIG. 26 shows a keelhaul cable snatch ring about to be snapped into recovery line hook in the jaw of a manipulator for a remote control vehicle (RCV);

FIG. 27 is a schematic side elevation of the forward portion of the process vessel, showing the keelhaul cable being pulled to the service moonpool by the RCV;

FIG. 28 is a perspective view of a portion of the process vessel which shows three flexible pipes installed as catenaries between the turret moonpool and the service moonpool;

FIG. 29 is a schematic cross-section side elevation view of the turret moonpool, the turret containing the plug, and the column shaft, with the above-deck portion of the shaft being reduced in size and with the bridle cables being supported by the keelhaul winches and the central cable passing over the laydown sheave to the laydown winch;

FIG. 30 is a plan view of the service moonpool, showing a spreader beam in the moonpool and another spreader beam in phantom within the storage area and the yoke beam also in phantom adjacent thereto;

FIG. 31 is a schematic sectional side elevational view of the turret moonpool, showing an additional hose being pulled into the plug and attached to the support frame with a connector;

FIG. 32 is a detailed schematic side elevation view of the large connector which supports the plug from the support frame of FIG. 31;

FIG. 33 is a schematic side elevation view of the process vessel and riser section showing the 12-inch hose and bridle cables attached to four spreader beams, as the initial stage of forming a flowline bundle, while an 8-inch hose is being pulled into the turret moonpool;

FIG. 34 is a schematic side elevation view which shows a diver pulling the 8-inch hose toward the first spreader beam below the service moonpool;

FIG. 35 is a schematic side elevation view, looking athwart the vessel, which shows the 8-inch hoses inserted through a gate or guide in the yoke, being lowered to operating position at the yoke;

FIG. 36 is a schematic side elevation view of the service moonpool, looking fore-and-aft of the vessel, after the 8-inch hose has been lowered to operating position through at the yoke; and FIG. 37 is a schematic side elevation view of the process vessel and flowline bundle as the 8-inch hose is being installed by a diver in the spreader beam below the turret moonpool.

DESCRIPTION OF THE SPECIFIC EMBODIMENTS

In the following explanation of the inventive concept, it should be understood that the process vessel may be used with any submerged, free-standing lower riser section, whether a rigid conduit or a buoy-tensioned flexible tubing or hose, which is attached to the ocean floor and connected to a single wellhead, multi-well gathering and production system, and/or manifolds for receiving and handling oil and gas.

It should be further understood that although assembling a plurality of flexible flowlines into a flexible catenary bundle is preferred, these flexible flowlines may be individually connected from the turret moonpool to the riser section.

The preferred flexible flowlines are Coflexip multilayered sheathed conduits. These are round conduits having a protective outer cover of low-friction material. The flowlines are commercially available in a variety of sizes and may be provided with releasable ends.

The ribbon-type flowline bundle restrains the flexible conduits from substantial intercontact and provides sufficient clearance at the spreader beams to permit unhindered longitudinal movement. Flexible conduits may thereby be retained in parallel alignment or "ribbon" relationship substantially throughout their entire lengths. The transverse spreader beams, which are longitudinally spaced along the flowline bundle, enable multiple conduits of equal length to be held in parallel relationship.

The Process Vessel and Its Operating Capabilities

Figure 1:
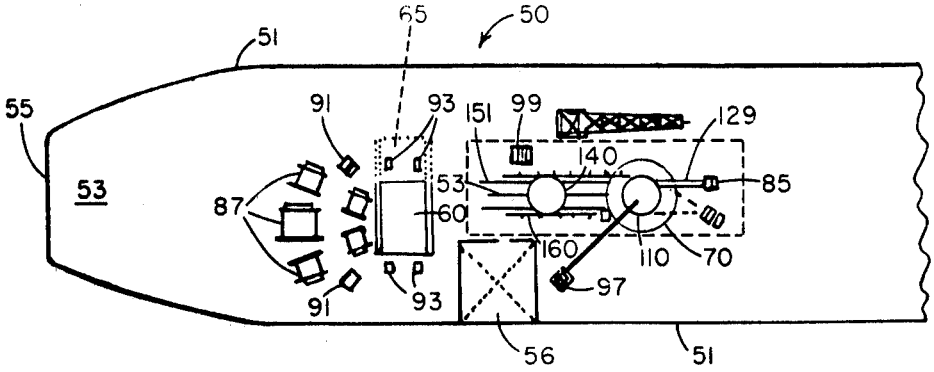
FIG. 1 is a schematic plan view of a process vessel showing the pair of moonpools and some of the associated structures on deck, the structure outlined by a box in phantom being this invention.
Figure 2:
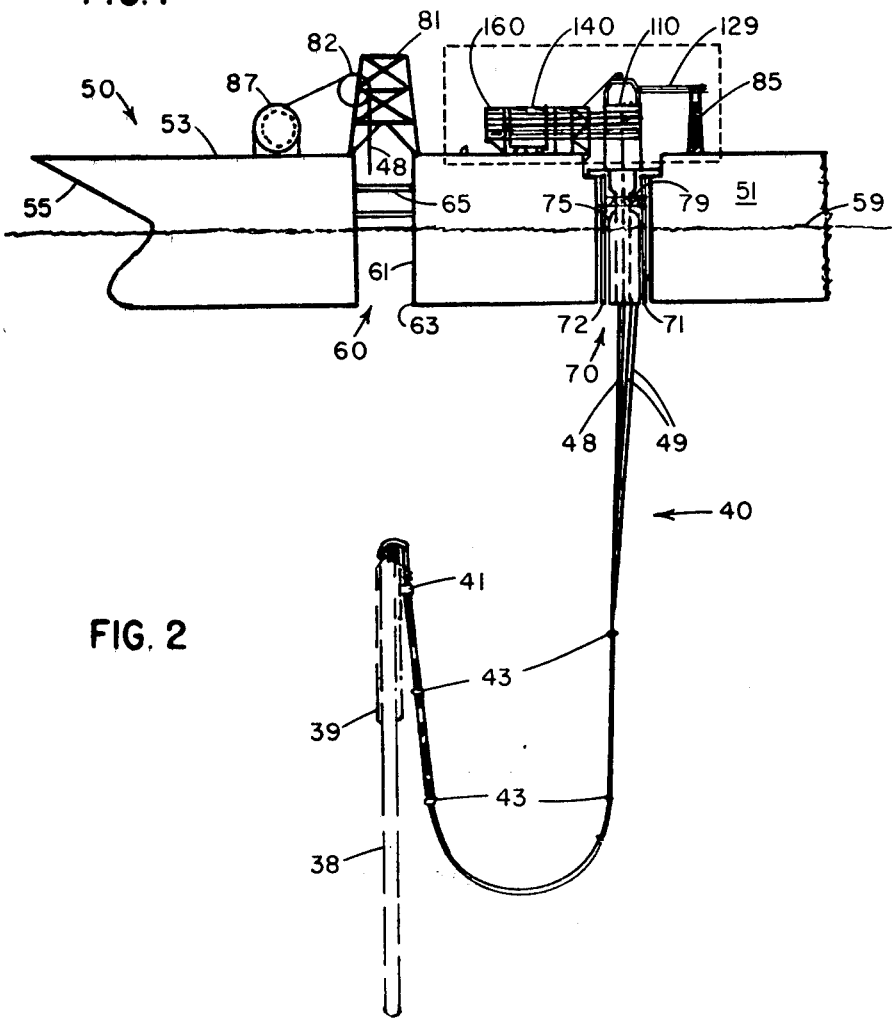
FIG. 2 is a schematic side elevation view of the process vessel which is on station and maintaining production of hydrocarbon fluids through a flowline bundle connected to a fixed production riser section extending from the marine floor, the structure outlined by a box in phantom being this invention.
Figure 3:
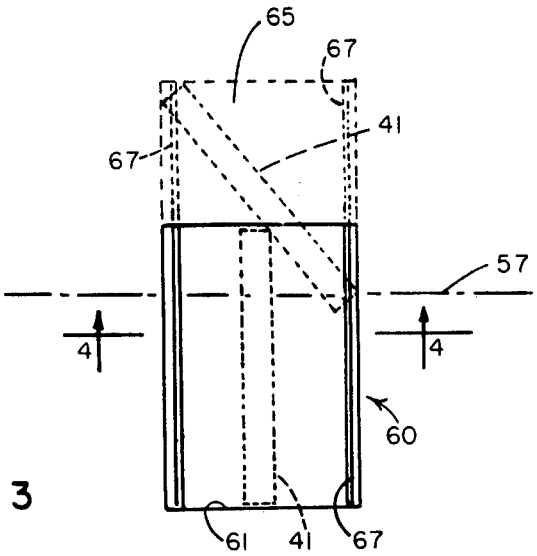
FIG. 3 is a detailed plan view of the service moonpool and of the associated below-deck storage facilities in phantom, showing the yoke beam in storage and after movement into the moonpool.
Figure 4:
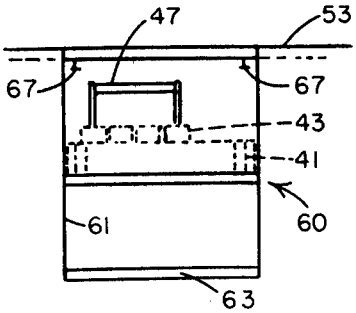
FIG. 4 is a detailed vertical cross section view along lines 4—4 of FIG. 3, showing the yoke beam in position.

As seen in FIGS. 1 and 2, vessel 50 is on station within a watch circle while operatively attending a flowline bundle 40 of service and production hoses which is attached at its inlet end to a riser section 38 at an offshore location in the open sea. Riser section 38 has a buoy 39 at its upper end to maintain riser section 38 in a vertical position under tension, below that zone of water below the surface which is normally affected by surface conditions, e.g., waves, currents, surface winds, etc.

Yoke 41 of flowline bundle 40 is attached to the top of riser section 38, and four spreader beams 43 hold component hoses 48,49 of flowline bundle 40 in a linear relationship in order to minimize chafing and entanling thereof. The upper or discharge end of flowline bundle 40 passes through turret moonpool 70 of vessel 50 and particularly passes through ejectable plug 75 which is within and attached to rotary turret 72 within turret moonpool 70. Hoses 48,49 are thereafter connected to terminal hoses passing through a column shaft 110 to a traveling sheave 140 or through a swivel assembly 120 to a tower 85 on main deck 53 of vessel 50. The terminal hoses are maintained in horizontal posture by a hose support tray assembly between traveling sheave 140 and column shaft 110 and between tower 85 and swivel assembly 120.

As the winds and swells change direction, the process vessel is free to weathervane around turret 72 in order to head under power into the prevailing wave, swell, and wind conditions in order to maintain flowline bundle 40 in a preferred catenary shape without twisting the bundle of hoses, while production of petroleum fluids and servicing of flowline bundle 40 proceed on a routine basis. In effect, rotary turret 85 remains stationary while vessel 50 rotates and while a rotary fluid subsystem transfers production fluids, electrical power, hydraulic power, and control signals across a rotating interface from flowline bundle 40 to vessel 50 through terminal hoses which are horizontally supported and kept under uniform tension during at least 270° of weathervaning.

However, whenever weather conditions appear to be threatening, vessel 50 is capable of operational disconnection with a minimum of three hours advanced notice by ejecting plug 75 and flowline bundle 40 attached thereto, leaving a buoy connected to the plug, to be located after the anticipated bad weather has blown over.

Vessel 50 is also capable of emergency disconnection operations, if adequate advance notice is not available, by making emergency disconnection at yoke 41 to allow hose bundle 40 to fall away from subsurface buoy 39 and hang vertically below the vessel. These disconnection operations, whether operational or emergency, can be performed by remote control but can also utilize backup manual disconnection facilities that are available.

Structural and Auxiliary Features of the Process Vessel

Vessel 50 comprises an elongated hull having sides 51, a main deck 53, a bow 55, and a fore-and-aft center line 57. Vessel 50 additionally comprises a diving area 56 and a pair of moonpools 60,70 which extend from main deck 53 to open bottom ends below water line 59. Vessel 50 also comprises numerous pieces of auxiliary equipment, including winches, hose reels, and a derrick, which are disposed on main deck 53 around moonpools 60,70 and are used for: (a) storing and selectively lowering hoses 48,49 of various types and sizes into the water and manipulating the hoses and associated component parts to form flowline bundle 40; (b) suspending bundle 40 while connecting its intake end to buoyed riser section 38 and its outlet end to a rotary fluid transfer subsystem; and (c) retrieving individual hoses and even the entire bundle when maintenance or replacement thereof is needed. The moonpools and associated equipment and the interactive usages of the moonpools and these pieces of equipment are components of this invention.

Additional major items of equipment are disposed on or near the main deck and are components of this invention. They comprise:

(1) the rotary fluid transfer subsystem, including a plurality of transfer hoses 109, 129 for transferring fluids and power across rotating interfaces between the vessel and the bundle, and (2) the tensioning means, for maintaining tension on the transfer hoses 109,129 which are diposed between the interfaces and storage facilities on vessel 50, while the vessel receives production fluids and weathervanes under power around its turret plug 75 which is within its circular moonpool 70.

The forward moonpool is service moonpool 60 having sides 61, open bottom end 63, and an adjacent storage area 65 which is below main deck 53 and accessible on the starboard side of moonpool 60. A pair of overhead monorail cranes 67 extend throughout storage area 65 and along the entire length of service moonpool 60. This storage area minimizes the need for passing large items from the deck into service moonpool 60 which would require removal of the decking that is installed at the top of the moonpool. Items that are conveniently stowed in storage space 65 include: gooseneck piping spools for connection of yoke 41 to buoy 39, a gooseneck running tool 47, the four spreader beams 43 for the flowline bundle 40, and flowline yoke 41. The two overhead monorail cranes 67 have a capacity of 10 tons each for handling or moving equipment from storage into service moonpool 60.

Preferred dimensions for service moonpool 60 are at least 30 feet by 45 feet in plan view, preferably 32 feet by 45 feet, although a square opening of 36 feet by 36 feet is feasible but less convenient.

A rig floor is installed at the top of service moonpool 60 and is equipped with slips to support tubulars from $4\frac{1}{2}$ inch I.F. drill pipe to 12-inch 5,000 psi riser tubing. The weight of the 12-inch tubing to be supported is dependent upon the depth of water in which the riser is to be installed. For a water depth of 1,000 feet, a weight of nearly 150 tons must be accommodated by the rig floor (not shown in the drawings). Connection methods to be employed at the bottom of riser section 38 may require a rotary table at the rig floor.

Main deck 53 of vessel 50 supports a variety of auxiliary equipment, including a derrick 81 which is erected over service moonpool 60 and is equipped with a draw works to handle drill pipe for running and installing the riser buoy gooseneck sections. The maximum weight that is involved is no greater than about 50 KIPS. If derrick 81 is also used for pulling the riser section tubing, however, the draw works must be sized to handle about 150 tons for the rig floor. The draw works should also be compensated to minimize impact of the drill string on the riser buoy. The height of derrick 81 must allow for handling a single stand of drill pipe, and its structure must be capable of supporting various sheave loads for handling hoses, lift lines, guide wires, and flowline bundle support wires.

A plurality of hose reels 87 are also disposed forwardly of moonpool 60, and a pair of lift winches 91 are at each forward corner of moonpool 60. Four guide wire winches 93 with tensioners are at the four corners of moonpool 60, and a support wire winch 99 is disposed aft of moonpool 60.

Two of the lift winches are used for handling the yoke 41 and the flowline bundle 40 during initial installation (about 60 tons on each winch) and also for recovering flowline 40 after an emergency disconnect operation. These lift winches have deck-mounted ram tensioners to prevent impact of yoke 41 and riser buoy 39 during installation. A sheave for each lift line is mounted in derrick 81.

Guide wire winches 93, also equipped with tensioners, operate over sheaves in derrick 81 to allow different guide line spacing, as follows: four guide wires at 28 feet by 14 feet spacing for gooseneck installation, two guide wires at 41 feet spacing for yoke installation, and two guide wires at about two feet spacing for hose replacement operations.

Two flowline support wire winches are also provided to handle and replace the flowline bundle support wires or bridle cables. Each winch is a doubledrum waterfall type and handles two support wires or bridle cables. One winch 99 is located aft of service moonpool 60 and has snatch blocks on deck to fair lead the wires to either side of the service moonpool and over the lift line sheave in derrick 83 because support wires and lift wires are not required at the same time. The second support wire winch 99 is located aft of the turrent moonpool but is not shown in the drawings. It is identical to the support wire pull-in and replacement operations at turret moonpool 70. Two sheaves 139 (see FIG. 12) are mounted at the top of column shaft 110 to fair lead the wires from winch 99 down through turret 72.

Plug laydown winch 97 is located on the port side of turret moonpool 70 and forward thereof and provides the handling capacity for plug ejection and pull-in operations when an operational disconnection is being performed. This winch 97 is also needed for keelhauling the service and production hoses between moonpools 60,70 for installation and replacement operations. A large sheave 135 is mounted at the top of column shaft 110 for centering the laydown line over turret plug 75.

Turret Moonpool, Rotary Turret, and Plug

Turret moonpool 70 has a circular side 71 and contains a rotary-powered turret 72 having a circular turret side 73 and a flanged turret top 74, as seen in FIGS. 5–7. A plug 75 is selectively pulled into turret 72 for supporting the discharge end of flowline bundle 40. Plug 75 has circular side 76 and top 77. Plug 75 is preferably pulled into turret 72 until its bottom end is coincident with the keel of the ship and its top is at the pull-in support level where support beams are attached to side 73. Above this level, plug 75 has the shape of a cone which acts as an alignment guide when plug 75 is pulled in through the opening at the bottom end of turret 72.

Within plug 75 are 16 guide tubes 118 providing passages for the twelve hose assemblies and the two flowline bundle support wires or bridle cables, including two spares which are used whenever the support wires are required to be replaced. Each of these guide tubes 118 is located at the required orientation point and passes from the bottom of plug 75 to the pull-in support level. Preferred dimensions for plug 75 are an outside diameter of about 18–25 feet and a height of about 45–50 feet.

Although plug 75 is preferably in the shape of a cylinder with a conical front end, the plug can be constructed with other shapes. A conical shape, for example, has several advantages, such as multiple bearing surfaces and greater dispersal of the hoses as they enter the wide bottom end thereof.

Above top 77 of plug 75 is a support frame 79 as the main structural support level which is located about 15 feet above the pull-in support level. This support frame 79 consists of four main ladder support girders spanning turret walls 73, with fill beams for support of hoses 48,49 which are supported at this level during normal operating conditions. Open grid flooring is provided on top of the steel work. At this level, orientation of plug 75 is effected after initial installation or reconnection after operation disconnect.

The advantage of hoses 48,49 being supported at this level and not within the plug is that the constant upward force of 210K on plug 72 always keeps the plug seated. In addition, there are minimum fatigue loads being transmitted upwardly and downwardly which might otherwise cause mechanical motions.

As seen in FIG. 25, after plug 75 has been pulled into turret 72, it is frequently necessary to orient plug 75 for hose connector alignment. A suitable mechanism for doing so comprises a pair of jacking cylinders 191 which work against the main structural support to rotate plug 75 via autolock connector 108. This autolock connector is provided as the remote release mechanism during an operational disconnection when plug 75 is simply dropped from turret 72. Autolock connector 108 is used for transmitting the major loading from plug 75 through the main support girders of support frame 79 and into the walls of turret 72.

Plug stops and latches (not shown in the drawings) are provided in three places, being attached to turret side 73 just above the pull-in support level. After orientation of plug 75 has occurred, the extension members on the stops are extended and pinned in position. Manual plug latches are also attached to these extension members. The plug stops take the upward force of plug 75, amounting to about 210K during normal operations, and the plug latches act as a backup for autolock connectors 108 in case of failure thereof. Autolock connector 108 is suitably about 30 inches in diameter.

Column Assembly

The Coflexip hoses of flowline bundle 40 pass through the 16 guide tubes 118 and terminate at a point approximately three feet above the pull-in support level of plug 75. At this hose termination point, remote releasable hub and clamp connectors 101, one for each hose, are provided for connecting the hoses 48,49 to straight lengths of production piping 102 which are vertically disposed and connected to offset spool pieces 103 and then to vertically disposed rigid piping 105,108.

Referring to FIGS. 8–10, rigid piping 105,106 is vertically disposed within column shaft 110 which has a circular side 113, bottom 111, top 114, and shelves 115. Column shaft 110 is suitably 35–40 feet in height and 18–25 feet in diameter. A convenient height is 39 feet with bottom 111 being supported on flange 74, about 10 feet below main deck 53. Top 114 is at the same height as the top of sheave shaft 140. A convenient internal diameter is 21 feet.

Vertical piping 105 contains production liquids moving at large volume and not containing gas, including the discharge from 12-inch hose 48. Vertically disposed piping 106 contains the remaining liquids and gases, including the discharge from the remaining smaller hoses 49, and also contains the lines extending from the service hoses. Piping 106 is bent to form horizontally disposed terminal portions which are attached to hose and clamp connectors 107, as seen in FIG. 9. Flexible hoses 109 are attached to the other ends of connectors 107 gradually pass through wall 113, and, while resting on contoured shelves 115, wrap at least two times around column shaft 110, thereby providing sufficient length for unwrapping while vessel 50 weathervanes through up to about 230°. The terminal portions, connectors 107, and hoses 109 become smaller in diameter from bottom 111 to top 114, beginning with 8-inch hose 106A. The six-inch hoses 106B, the 4-inch hoses 106C, and the 3-inch hoses 106D, in turn, bend 90°, are attached to connectors 107, and then continue as hoses 109 through wall 113 onto shelves 115 to form wraps 117 (see FIG. 11) around column shaft 110 before passing horizontally to traveling sheave assembly 140.

Vertical piping 105,106 are arranged in a circular pattern, as seen particularly in FIG. 10, in order to minimize entanglement and optimize space for maintenance. Hoses 106 are spaced angularly apart by angular distances 104 which vary from 25° to 36°. The 12-inch piping 105, however, is separated on each side by an angle of 40° from the adjacent 3-inch piping 106C.

Multipassage Swivel Assembly, Tensioning Mechanisms, Tower, and Sheave Assembly The large-volume, liquid-containing piping 105 continues vertically upward through column shaft 110 to a multipassage swivel assembly 120 which is mounted atop column shaft 110 and on a platform 122, as shown in FIGS. 11 and 12. Multipassage swivel assembly 120 is preferably a three-passage toroidal swivel developed by IMODCO. The assembly shown in FIGS. 13–16 has pipe bends up to three times the diameter of the piping. Production lines 105 handled through swivel assembly 120 are: one 12-inch diameter (5,000 psi) group line, one 8-inch diameter (4,000 psi) water injection line, and one 6-inch diameter (2,000 psi) gas lift line. Each of these lines 105 passes vertically through column shaft 110 to swivel assembly 120 and from swivel assembly 120 to tower 85.

The toroidal swivel is designed with seals 124 between outer race 125 and inner race 123 of each torroidal chamber 121. Inner race 123 moves with turret 72, while outer race 125 moves with process vessel 50. Laydown line 137, used for pulling plug 75 and the Coflexip hoses 48,49 to vessel 50, passes through the core of swivel assembly 120.

Swivel assembly 120 is a three-layered device, as seen particularly in FIG. 14, which has inlets connected to piping 105 and outlets 127. As seen in FIGS. 11 and 12, outlets 127 are connected to flexible terminal hoses 129 which pass through tower 85 and hence to storage facilities on vessel 50 while being supported on a hose support tray assembly which, for simplicity, is not shown in the drawings.

Swivel assembly 120 maintains the length of terminal hoses 129 to a precise degree as vessel 50 weathervanes and thereby controls the tension of these hoses. However, it is necessary that the length of the hoses be adjusted fairly precisely, and hose tensioning mechanism 180 is used for this purpose on these large diameter hoses. As seen in FIG. 23, a hose 129 is joined to a connector 181 and then to production piping 185 which passes through spacer plates 183 and then downwardly to vessel storage. A turnbuckle 187, attached to tower 85, allows production piping 185 to be deflected up to 2 inches over a length of 50 feet, and additional spacer plates 183 may be added as necessary at the termination point to insure that hoses 129 have equal lengths.

On top of column shaft 110, a sheave assembly 130 is also mounted. This assembly comprises a frame 131 which is attached to top 114 of column shaft 110, roller bearings 133 which allow frame 131 to rotate as vessel 50 weathervanes, a laydown sheave 135 which is mounted on top of frame 131 and which is centered over turret moonpool 70 and over which laydown line 137 passes, and a pair of support wire sheaves 139 over which bridle cables 209 pass for supporting the flowline bundle 40 and plug 75.

Traveling Sheave Assembly

As seen in FIG. 11, production lines, containing gas and other fluids, and service lines, such as hydraulics and electrical lines, pass from column shaft 110 to a traveling sheave assembly, comprising a circular shaft 140, support beams 152, trolleys, travel rails 151, grip rail 153, friction gripper 154, and a hose support tray assembly 160 or. Traveling sheave shaft 140 has a bottom 141, a circular side 143, a top 144, contoured shelves 145, and vertical support flanges 147 which are shown in FIG. 19.

Traveling sheave shaft 140 is supported on support beams 152 which are attached to trolleys comprising four trolley wheels 155 and axles 157, as seen particularly in FIGS. 20 and 21, which ride on a pair of travel rails 151, as shown in FIG. 24.

Sheave shaft 140 is attached to support beams 152 so that hydraulics, production, and electrical lines 109 must slide over shelves 145 as shaft 140 moves over rails 151. Shelves 145 have increasing depth from top to bottom so that the axes of three-inch lines near top 144 are directly above the axes of eight-inch lines near bottom 141 and the axes of all lines 109 on shelves 145 have equal distances to travel. In relative terms, each shelf 145 is therefore recessed by one-half of the diameter of the hose that it is to support.

Shelves 145 are preferably coated with a lowfriction material, such as Teflon ®, and are also equipped with roller bearings for the heavier hoses. Lines 109 are additionally Teflon ® coated so that frictional resistance to movement of lines 109 around shaft 140 is minimal.

The hoses wrap around the sheave shaft on a pitch radius of at least about eleven feet.

As another specific embodiment, bottom 141 rests on a circular row of radially aligned roller bearings within a circular track (not shown in the drawings) which is supported on beams 152, whereby the sheave shaft rotates on its support beams 152 as it travels over rails 151. The force required for rotation may be supplied by frictional contact with the hoses but is optimally supplied by an electrical motor which is attached to beams 152, is equipped with an axially attached pinion, and is connected to a circular rack within circular side 153.

Traveling sheave shaft 140 is preferably moved by a friction gripper 154 which is mounted on the underside of and in the center of traveling sheave shaft 140. It is provided with a pulling cylinder powered by a hydraulic stroke of approximately two feet. This pulling cylinder is designed to reach out, grip the centrally disposed grip rail 153, and pull sheave shaft 140 along on rails 151 as seen in FIG. 22.

However, alternate methods of driving sheave shaft 140 are feasible, such as a winch or gear driven endless cable which is powered by either electrical or hydraulic means, overhead power lines which are either electrical or hydraulic and run from a centrally located power station, a rack and pinion drive with power supply that is either electrical or hydraulic, and a long hydraulic cylinder or lead screw.

Hose Support Tray Assembly

As indicated in FIGS. 17–19 and 24, hose support trays are used for supporting hoses 109 between column shaft 110 and sheave shaft 140. Hose support tray assembly 160 with fixed arms is shown in FIGS. 17–19 and comprises tray columns 161, bracing 163, and fixed trays 165. These trays are provided to give continual support over the whole lengths of hoses 109, from the point of passing from column shaft 110 until the hoses reach shelves 145 of sheave shaft 140. These hose support trays are also disposed between swivel assembly 120 and tower 85 to support hoses 129 carrying large volumes of production liquids, although they are not shown in the drawings.

A hose support tray assembly can be provided with either fixed arms or rotating arms. Fixed arms are shown in FIGS. 17–19, and rotating arms are shown in plan view in FIG. 24. With either assembly, there are six columns provided on the starboard side of process vessel 50, where the hose comes off column shaft 110, and there are four columns on the port side. Spacing of these columns is preferably no greater than about 10 feet.

The hose support tray assembly with rotating arms 170 comprises a plurality of tray columns 171, fixed arms 173 attached to the two aft columns on the starboard side, and swinging arms 175 which are attached to the other column and are shown in phantom in the transverse or support position and in solid line in parallel position to the path of travel of traveling sheave shaft 140. Sheave shaft 140 is shown in FIGS. 12 and 24 in its nearest position to moonpool 70 and also in phantom in position 146 at its outermost position, against stop 159. Sheave shaft 140 is under control of an operator 158 at a control console alongside rails 151.

Operational Procedure for Assembling a Flowline Bundle

Operation of process vessel 50 for assembling a flowline bundle 40, this operation not being a part of this invention, is shown schematically in the series of drawings in FIGS. 26–37. Process vessel 50 is either moored or dynamically positioned over subsurface buoy 39 with the buoy about 200 feet forward of surface moonpool 60, turret moonpool 70 having been previously equipped for full line installation with plug 75 in position and piping spools 103 above plug 75 having been removed to allow vertical access to plug 75, and service moonpool 60 having been equipped for initial full line installation with all Coflexip hoses stored on reels 87 ready for deployment and with yoke 41 and spreader beams 43 below deck to one side of service moonpool 60 within storage area 65. All Coflexip hoses are fitted with two connectors, one at each end, at service moonpool 60. The electrical umbilical is equipped with short pigtail cables which will act as jumpers from the yoke to the electrical termination on the buoy after installation. Each pigtail is terminated with a wet make and brake electrical plug which is capped prior to lowering the yoke.

A keelhaul cable 202 is lowered into turret moonpool 70 and dropped through the 12-inch guide tube in plug 75 until a snag ring 207 on the end of cable 202 hangs below vessel 50 by at least 50 feet. A light recovery line 205 is mounted on a small winch on a remote control vessel (RCV) 201, and the end thereof is fitted with a snap hook 206 and placed in the jaw of an RCV manipulator 203. RCV 201 is then launched through service moonpool 60 and sent toward turret moonpool 70, carrying recovery line 205 to snag ring 207. Recovery line hook 206 is snapped into keelhaul cable snap ring 207, as seen in FIG. 26. RCV 201 is then returned to service moonpool 60, while paying out recovery line 205. Keelhaul cable 202 is pulled to service moonpool 60 and attached to the termination or discharge end of the 12-inch Coflexip hose 48, as indicated in FIG. 27.

This procedure is repeated until a total of three keelhaul cables 202 have been transferred and attached, within service moonpool 60, to the 12-inch Coflexip hose 48 and to two flowline bundle support or bridle cables 209 which straddle hose 48, as schematically indicated in FIG. 28. As shown in FIG. 29, all three keelhaul cables 202 are next routed through guide tubes 78 and through sheaves 135,139 to winches 97,95, respectively, which are mounted on main deck 53.

Then 12-inch hose 48 and the two bridle cables 209 are payed out from service moonpool 60, as winches 97,95 are operated to pull in keelhaul cables 202 and as a hose reel 87 and support wire winch 99 are cooperatively reversed, until the ends of bridle cables 209 are at the working deck level in service moonpool 60. The first spreader beam 43 is moved from its stowed position in storage area 65 into service moonpool 60, the two bridle cables 209 are placed in gates 46 at the ends of the first spreader beam 43, and the 12-inch hose 48 is installed in spreader beam 43 through its central gate 46. All other spreader beam gates 46 are locked open for subsequent hose installations. FIG. 30 shows spreader beam 43 in position with hose 48 locked into its central gate.

This procedure of installing spreader beams 43 is repeated, while paying out the entire length of 12-inch hose 48 and bridle cables 209, and while cooperatively maintaining some tension on keelhaul cables 202 with winches 95,97 to prevent rotation of flowline bundle 40, until the entire flowline bundle 40 is hanging under vessel 50 with the three keelhaul cables 202 attached to its lower end. The three keelhaul cables are next pulled toward turret moonpool 70 to lift 12-inch hose 48 and bridle cables 209 into the turret moonpool. Hose 48 and bridle cables 209 are lifted through guide tubes 78 in turret plug 75 to a position at top 77 of plug 75, as indicated in FIG. 31. Hose 48 is secured to plug 75 with a split pedestal assembly 211, and a protective pulling cap over the end of hose 48 and its keelhaul wire 202 is removed. An autolock connector 108 and a vertically disposed spool are lowered until the connector and pin are fully engaged, as indicated in FIG. 32. The connector is then hydraulically locked to hose 48. Support wires 209 are secured at top 77 of plug 75, and the weight of the wires and of spreader beams 43 is hung on plug 75. Then keelhaul wires 202 are removed.

Yoke 41 is moved from its storage position in area 65 below deck 53 to service moonpool 60 and attached to bridle cables 209, being positioned there for subsequent lowering to subsurface buoy 39 after flowline bundle 40 is fully assembled. Twelve-inch hose 48 is inserted through the central yoke gate, and the gate is closed. After pressure test fittings are attached to the discharge end of 12-inch hose 48, the hose is pressure and leak tested from connector to connector over its whole length.

The remainder of the flowline bundle elements are now installed individually, the preferred sequence of installation progressing from 12-inch hose 48 in the center of yoke 51 toward either end thereof in the following order of installation: 8-inch gas injection at 6,000 psi, 8-inch water injection, 6-inch gas lift, electrical umbilical, 4-inch TFL at 6,000 psi, 4-inch well tesk at 5,000 psi, 4-inch purge at 1,000 psi, 3-inch life support (consisting of three hoses) at 1,000 psi, and a hydraulic control hose bundle at 3,000 psi.

The installation procedure for sequential installation of these additional eleven flowline bundle elements must be done carefully to prevent entanglement with previously deployed hoses and cables. More specifically, the 8-inch Coflexip hose 49, for example, is pulled from its storage reel 87 over sheave 82 in derrick 81 until the termination or discharge end reaches the working deck in service moonpool 60. The keelhaul cable 202, which had previously been payed out from turret moonpool 70 after RCV 201 had attached a recovery line 205 thereto, is attached to the 8-inch Coflexip hose, and the hose is lowered through the service moonpool until it is fully extended. Then 8-inch hose 49 is pulled to turret moonpool 70 and raised through its respective guide tube 78. The 8-inch hose is next secured to top 77 of plug 75, and a connector and spool are connected thereto. The 8-inch hose is then fed from storage reel 87 until the termination or inlet end is about to leave the drum thereof, whereby hose 49 maintains a shallower catenary than the catenary of 12-inch hose 48 in spreader beams 43. It is secured in this position, as shown in FIG. 33.

Divers are lowered from diving area 56 in a bell 204 over the side of vessel 50 to the uppermost spreader beam 43 below service moonpool 60, as depicted in FIG. 37. A small hydraulic winch 208, as seen in FIG. 34, is used to pull 8-inch hose 49 to spreader beam 43 and through the open gate thereof so that the gate can be closed and locked by the diver. The 8-inch hose is then payed out until the termination or inlet end is about 30 feet above yoke 41, as shown in FIG. 35. Then 8-inch hose 49 is placed in this gate in yoke 41, and the gate is closed, as seen in FIG. 36.

Divers' bell 204 is lowered to the second spreader beam 43, and 8-inch hose 49 is pulled into the second spreader beam 43 in the same manner as for the first spreader beam. Then the divers are recovered and bell 204 is lowered over side 51 of the ship at turret moonpool 70 to install the 8-inch hose in the final two spreader beams 43. During this operation, 8-inch hose 49 is lowered in service moonpool 60 until its termination or inlet end rests on yoke 41. Finally, the emergency disconnect connectors are installed on 8-inch hose 49, and the hose is pressure and leak tested.

This procedure is repeated for the remaining elements of flowline bundle 40, proceeding from the middle toward each end of all spreader beams 43 and yoke 41.

The hydraulic control bundle is terminated with a block manifold which is secured to yoke 41 in a special gate. Hose connections between the manifold and yoke 41 are made at the surface which allows testing prior to installation. A segmented hose support device is lowered through the guide tubes of turret plug 75 to provide bending support for each hose at the bottom of the plug.

Installation of the Flowline Bundle

Yoke 41 is now hung off in service moonpool 60 with all flowlines and cables attached. Flowline bundle 40 is stretched between moonpool 60,70 in a catenary or sling reaching a depth of approximately 300 FSW. At this stage, the connectors at both ends of the flowlines in bundle 40 have been installed and tested, and all hydraulic controls for emergency disconnection have been checked out to verify proper function. The process vessel 50 is located with riser buoy 39 about 100 feet forward of service moonpool 60.

Process vessel 50 is now moved forward until riser buoy 39 is just forward of service moonpool 60, and the lowering cables are payed out by the forward flowline support wire winch 99 (see FIG. 1) until yoke 41 is in position about 50 feet below the connection point on riser buoy 39 while maintaining a level yoke attitude in order to obviate the hose damage that can occur if yoke 41 becomes seriously out of level. Using a diving bell which is lowered over side 51 to the depth of riser buoy 39 at about 200 FSW, divers connect short handling lines to guide wires above yoke 41 as vessel 50 is maneuvered as close as practical to riser buoy 39. The divers then bring the yoke into engagement with riser buoy 39.

The lowering lines and guide wires are released by the diver or RCV and recovered to the surface. The primary connectors are individually closed from the service moonpool to lock the production flowlines to the gooseneck piping at riser buoy 39, and all hoses are pressure tested from the turret moonpool to the shut off valves at the top of the riser. The electrical control umbilical pigtails are connected by the diver to the electrical termination on the buoy, and flexible hydraulic connections are also made by the diver from yoke 41 to each fail-safe shut-off valve. The assembly is now complete.

After functional testing of all ocean bottom production equipment, process vessel 50 is prepared for initial maintenance of flowline bundle 40 and for routine operation of the bundle to receive process fluids through hoses 129,209 and for storage within the vessel while weathervaning to keep on station during all but the most inclement weather.

What is claimed is:

1. A rotary fluid transfer subsystem, for transfer of production fluids, electrical power, hydraulic power, and control signals across a rotating interface between an offshore process vessel and a flowline bundle of service hoses and high-pressure hoses which are connected to a deepwater production riser system, and a tensioning means, for maintaining a selected tension on terminal hoses between said interface and said vessel while said vessel weathervanes during maintenance of position in a watch circle above said riser system, said subsystem and said tensioning means being mounted on said vessel which is equipped with a powered turret within a circular moonpool and is capable of performing most subsea service functions on said riser system without major equipment support, said subsystem and said tensioning means, in combination, comprising:

A. a column assembly which is attached to said turret and supports horizontal loops of terminal hoses;

B. a multi-passage swivel for accommodating a portion of said terminal hoses not containing gas;

C. a tower for selectively tensioning said portion of said hoses and for connecting said hoses to production piping;

D. a traveling sheave and drive mechanism which supports horizontal loops of the remaining portion of said hoses while maintaining tension on and adjusting the lengths of said remaining hoses, between connections to storage facilities in said vessel and said column assembly, while said column assembly remains rotatably stationary with respect to said flowline bundle during said weathervaning of said vessel through at least 270°; and E. hose support trays for supporting horizontal spans of said hoses between said tower and said column and between said column and said traveling sheave.

2. The combined subsystem and traveling means of claim 1, wherein said turret is disposed between said tower and said traveling sheave and drive mechanism.

3. The combined subsystem and traveling means of claim 1, wherein said traveling sheave and drive mechanism comprises a sheave shaft and a plurality of trolleys which ride on rails attached to a deck of said process vessel, said sheave shaft being mounted on support beams.

4. The combined subsystem and traveling means of claim 3, wherein said sheave shaft is disposed in upright position and rotates while traveling along said rails.

5. The combined subsystem and traveling means of claim 4, wherein said drive mechanism comprises a friction gripper which is provided with a pulling cylinder and grips a rail disposed beneath said sheave shaft to provide said traveling.

6. The combined subsystem and traveling means of claim 4, wherein said rails are aligned with said turret.

7. The combined subsystem and traveling means of claim 6, wherein said traveling covers a distance of at least about 50 feet.

8. The combined subsystem and traveling means of claim 6, wherein said sheave shaft is provided with shelves which support said hoses.

9. The combined subsystem and traveling means of claim 8, wherein said hoses wrap around said sheave shaft on a pitch radius of at least about eleven feet.

10. The combined subsystem and traveling means of claim 6, wherein said column assembly comprises:

A. a circular column shaft which is equipped with shelves and is mounted atop said turret;

B. production piping which is disposed on the inside of said column shaft; and

C. terminations for said piping which are disposed at different tangential positions throughout the height of said column shaft, said terminal hoses being attached to said terminations.

11. The combined subsystem and traveling means of claim 10, wherein:

A. said column shaft is cylindrical and has the same diameter as the diameter of said sheave shaft;

B. the top of said column shaft is at the same elevation above said main deck as the top of said sheave shaft; and C. the top of said turret is substantially below said main deck.

12. The combined subsystem and traveling means of claim 11, wherein each said hose wraps around said column shaft a minimum of two times at a minimum pitch diameter of about 20 feet, the first wrap being supported on one of said shelves, whereby storage capacity for said remaining hoses is provided on said column shaft.

13. The combined subsystem and traveling means of claim 12, wherein a multi-passage gas-containing high-pressure swivel is mounted atop said column shaft for said hoses.

14. The combined subsystem and traveling means of claim 13, wherein said multi-passage swivel is a three-passage toroidal swivel.

15. The combined subsystem and traveling means of claim 14, wherein said three-passage toroidal swivel comprises three toroidal chambers and seals between the outer and inner races of each said chamber, said inner race moving with said turret, and said outer race moving with said process vessel.

16. The combined subsystem and traveling means of claim 15, wherein said hoses pass from said swivel to said tower and include all high-pressure liquid production gas lines.

17. The combined subsystem and traveling means of claim 16, wherein said hose support trays are supported on a plurality of support columns which are disposed in a pair of rows parallel to and straddling said rails.

18. The combined subsystem and traveling means of claim 17, wherein said support columns are each provided with a plurality of horizontally disposed arms.

19. The combined subsystem and traveling means of claim 18, wherein said arms are selectively swingable from a position that is perpendicular to said rails to a position that is parallel thereto as said sheave column travels past said support columns.

20. The combined subsystem and traveling means of claim 19, wherein a support frame and sheave are mounted atop said column shaft for handling laydown lines attached to a turret plug which is selectively pulled into said turret.

* * * * *